United States Patent [19]

Nose

[11] Patent Number: 4,939,706

[45] Date of Patent: Jul. 3, 1990

[54] TRANSACTION PROCESSING APPARATUS WITH A MONITOR SYSTEM FOR MONITORING DRAWER OPENING AND CLOSING CONDITIONS

[75] Inventor: Eishi Nose, Kyoto, Japan

[73] Assignee: Omron Tateisi Electronics Co., Kyoto, Japan

[21] Appl. No.: 391,027

[22] Filed: Aug. 9, 1989

[30] Foreign Application Priority Data

Aug. 19, 1988 [JP] Japan ..... 63-206750

[51] Int. Cl.[5] ..... G04B 47/00; G08B 13/08

[52] U.S. Cl. ..... 368/10; 340/545

[58] Field of Search ..... 368/10, 9, 107–113; 340/545, 692, 522, 309.15, 309.4

[56] References Cited

U.S. PATENT DOCUMENTS

| | | | |
|---|---|---|---|
| 4,368,030 | 1/1983 | Benedetti | 368/10 |
| 4,463,348 | 7/1984 | Sidebottom | 340/585 |
| 4,835,520 | 5/1989 | Aiello | 368/10 |

*Primary Examiner*—Vit W. Miska

*Attorney, Agent, or Firm*—Dickstein, Shapiro & Morin

[57] ABSTRACT

A transaction processing apparatus is provided which includes an alarm output unit which generates an alarm output when a comparator determines that the elapsed time during which a drawer of the processing apparatus has remained open is greater than or equal to a predetermined reference value. In addition, the apparatus includes a storage means for recording an indication of the time during which the drawer remains open for each one of a plurality of operators of the apparatus. The apparatus includes a counter for counting the elapsed time from a time when it is determined that the drawer is open and a second time when it is determined that the drawer has been closed. This elapsed time is compared by a comparator with a stored reference value to control triggering of the alarm output unit. Each of the plurality of operators is assigned a separate discrimination code which is stored in a memory and provided to the storage unit which stores the discrimination codes in association with the elapsed time count provided by the counter such that the operator discrimination codes and the elapsed time counts relating to each of the operators are recorded in association with one another, to enable a supervisor to monitor the various operators.

7 Claims, 3 Drawing Sheets

TRANSACTION PROCESSING APPARATUS WITH A MONITOR SYSTEM FOR MONITORING DRAWER OPENING AND CLOSING CONDITIONS

FIELD OF THE INVENTION

The present invention relates to a transaction processing apparatus having a drawer, such as an electronic cash register or the like.

BACKGROUND OF THE INVENTION

In a conventional transaction processing apparatus having a drawer, the operating state of the drawer is not monitored when the drawer remains open. No alarm indicating a drawer-open condition is sounded, and the operating state of the drawer is not recorded.

In the conventional drawer referred to above, problems exist in that if an operator opens the drawer to steal money therefrom and the operator goes to other places away from the drawer with the door remaining open, the money can be easily stolen from the drawer. The conventional apparatus has no means to prevent such problems.

SUMMARY OF THE INVENTION

To solve the above problems present in conventional apparatus, a first object of the invention is to prevent the drawer from remaining open by action of the operator. A second object of the invention is to provide means whereby a manager can readily comprehend the actual situation regarding the opening and closing operations of the drawer by an operator or operators.

To attain the above-described first object, the present invention provides a transaction processing apparatus with means for monitoring drawer open and close conditions. This monitoring means comprises open judging means for judging that the drawer is open, close judging means for counting elapsed time from a time when the drawer is judged to be open by the open judging means to a time when the drawer is judged to be closed by the close judging means, memory means for storing a predetermined reference value relating to a drawer opening time, comparing means for comparing the elapsed time counted by the time counting means with the reference value of the drawer opening time stored in the memory means, and alarm means for giving an alarm output when the result compared by the comparing means shows that the drawer opening time is not less than the reference value.

To attain the second object, the invention provides a transaction processing apparatus with a means for monitoring open and close conditions of a drawer, comprising discrimination code input means for inputting a discrimination code of an operator, memory means for storing the operator discrimination code inputted by the discrimination code input means, open judging means for judging that the drawer is open, close judging means for judging that the drawer is closed, counting means for counting elapsed time from a time when the drawer is judged to be open by the open judging means to a time when the drawer is judged to be closed by the close judging means, and recording means for recording the operator discrimination code stored in the memory means and elapsed time data counted by the time counting means such that the discrimination code and the elapsed time data are recorded in association with each other.

The operation of the transaction processing apparatus for attaining the first object is as follows. When the operator open the drawer, the open judging means judges that the drawer is open. The time counting means starts to count the elapsed opening time of the drawer from the time when the open judging means judges that the drawer is open. The elapsed drawer opening time counted by the time counting means is compared by the comparing means with the reference value of the drawer opening time stored in the memory means. The counting operation of the drawer opening time by the time counting means and the comparing operation by the comparing means are repeatedly performed until the close judging means judges that the drawer is closed. When the result compared by the comparing means shows that the drawer opening time is not less than the reference value of the drawer opening time, the alarm means gives the alarm output.

The operation of the transaction processing apparatus for attaining the second object is as follows. First, the operator inputs his discrimination code by the discrimination code input means. The discrimination code inputted by the discrimination code input means is stored in the memory means. Thereafter, when the operator opens the drawer, the open judging means judges that the drawer is open, the elapsed time starts to be counted by the time counting means. When the close judging means judges that the drawer is closed, the time counting operation is completed by the time counting means so that the elapsed drawer opening time is provided by the time counting means. The elapsed drawer opening time provided by the time counting means is recorded by the recording means in association with the discrimination code of the operator stored in the memory means.

In accordance with the transaction processing apparatus for attaining the first object, the alarm output is given in the event that the elapsed time when the operator opens the drawer is not less than the reference value so that this operator, or other people around the operator, will notice that the drawer is open and will close the drawer, thereby preventing the drawer from remaining open by the operator.

In accordance with the transaction processing apparatus for attaining the second object, the operator discrimination code and the drawer opening time are recorded in association with each other so that the manager can grasp the actual situation of the opening and closing operations of the drawer by the operator or operators.

BRIEF DESCRIPTION OF THE DRAWINGS

The above and other objects, advantages and features of the invention will be more fully understood when considered in conjunction with the following discussion and the attached drawings, of which.

DETAILED DESCRIPTION OF THE PREFERRED EMBODIMENTS

Figure 1:
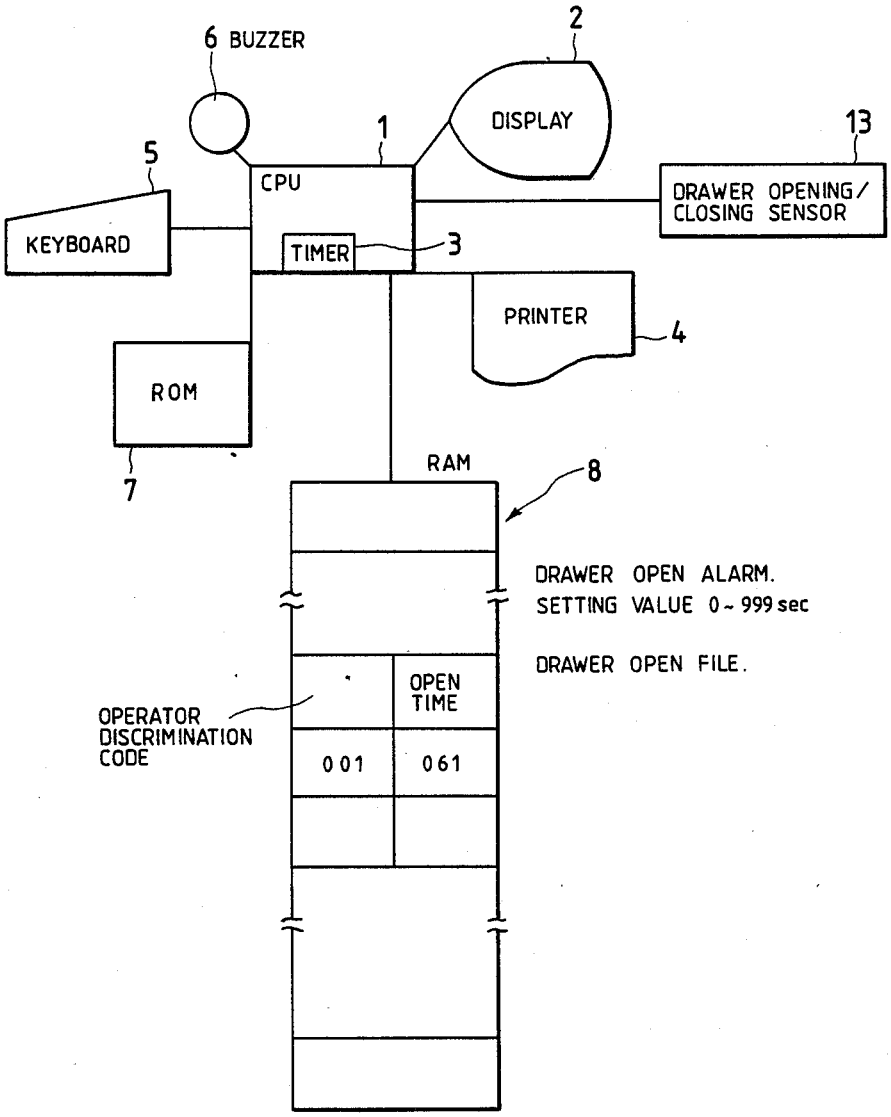
FIG. 1 is a block diagram showing a transaction processing apparatus.

FIG. 1 is a block diagram showing a transaction processing apparatus including a CPU 1, a display device 2 connected to CPU 1 for displaying messages, etc., a timer 3 connected to CPU 1 for counting time, a printer 4 connected to CPU 1 for printing messages, etc., a keyboard 5 connected to CPU 1 for inputting numerical data and commands, etc., a buzzer 6 connected to CPU 1 for sounding an alarm, a ROM 7 connected to CPU 1 for storing operating programs of CPU 1, and a RAM 8 connected to CPU 1 for storing a reference value of an opening time of a drawer (drawer open alarm), a recording file of the drawer opening time (drawer open file), data for work, etc. The apparatus further includes a drawer opening-closing sensor 13, connected to CPU 1, for detecting the opening and closing states of the drawer.

Figure 2:
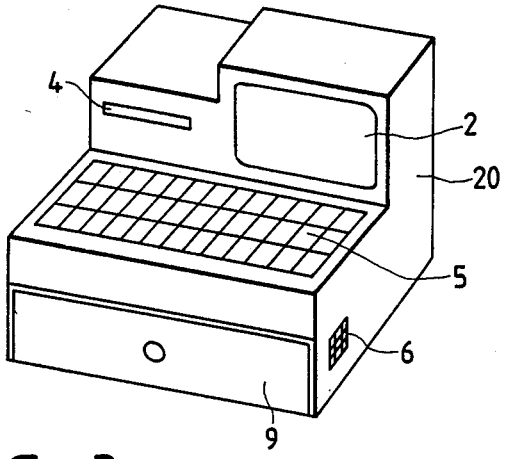
FIG. 2 is a perspective view of a transaction processing apparatus.

FIG. 2 is a perspective view showing an external appearance of the transaction processing apparatus. Reference numeral 10 represents a housing and reference numeral 9 represents a drawer or other holding means for holding money, with drawer or holding means 9 being openable and closable relative to housing 20.

Figure 3:
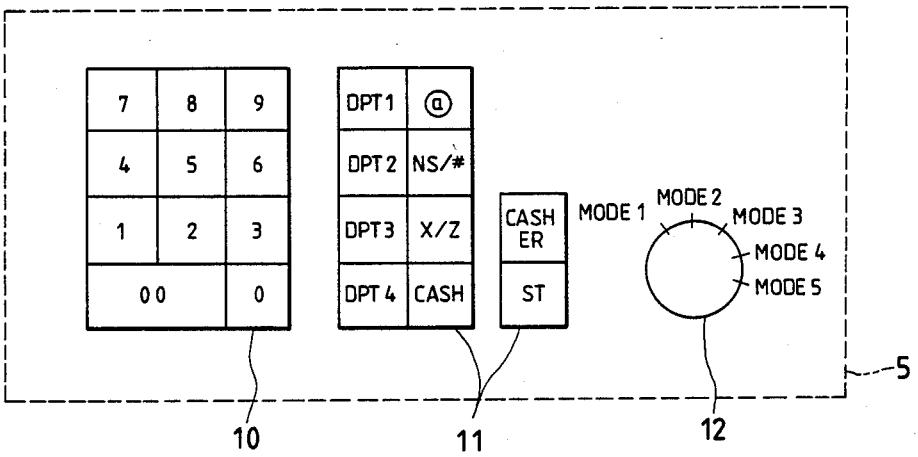
FIG. 3 is a view of a keyboard.

FIG. 3 is a view showing a detailed arrangement of keyboard 5. Reference numeral 10 denotes a ten-key array for inputting a numerical value. Key 11 is a function key having a special function. Switch 12 is a mode change-over switch for switching operating modes of the transaction processing apparatus. Mode change-over switch 12 is constructed such that a key for the switching operation is inserted into this switch and the key is then rotated to switch the operating modes. The keys able to be inserted into mode change-over switch 12 include a key for a manager and a key for an operator. When the key for the manager is used, mode change-over switch 12 can be switched to any mode from mode 1 to mode 5. When the key for the operator is used, mode change-over switch 12 can be switched to only mode 2 or 3. In this embodiment, mode 1 is a mode for setting the reference value of the drawer opening time. Mode 2 is a mode for performing no processing in a neutral state. Mode 3 is a mode for registering a price for an article and performing payment processing by the operator. Mode 4 is a mode for reading out the recording file of the drawer opening time. Mode 5 is a mode for clearing the recording file of the drawer opening time.

Figure 4:
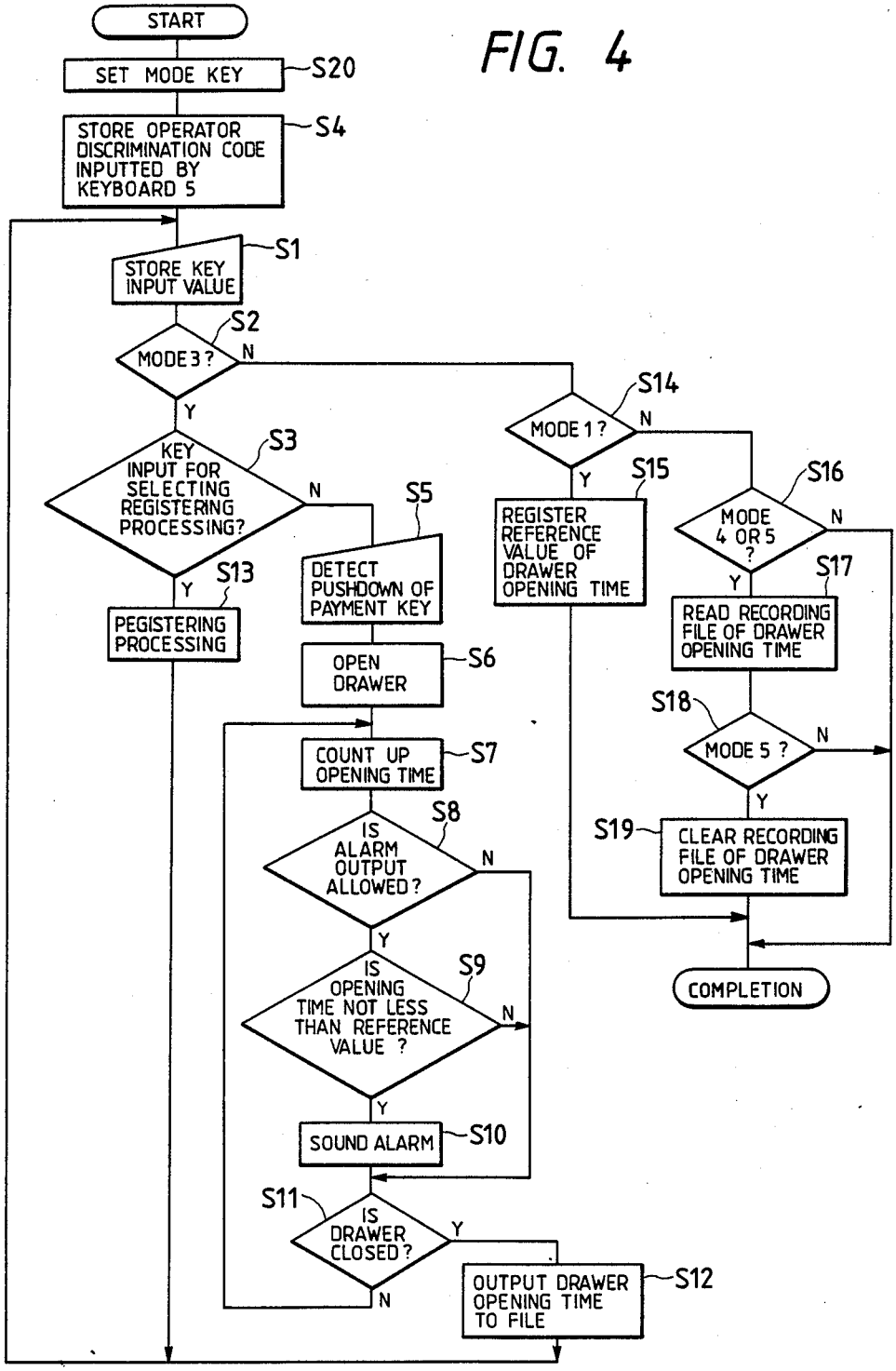
FIG. 4 is a flow chart of the operation of the transaction processing apparatus.

FIG. 4 is flow chart showing the operation of CPU 1 in the transaction processing apparatus.

Figure 5A:
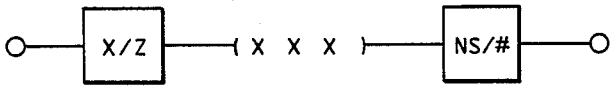
FIGS. 5*a*–5*c* are views showing operating sequences of the keyboard.
Figure 5B:
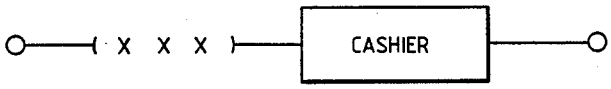
Figure 5C:
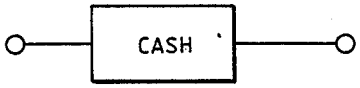

FIGS. 5*a*–5*c* are views showing operational sequences of the keyboard. FIG. 5*a* shows a sequence for inputting the reference value of the drawer opening time. FIG. 5*b* shows a sequence for inputting a discrimination code of the operator. FIG. 5*c* shows an operation of key 11 for opening the drawer.

A main operation of the transaction processing apparatus will now, be described with respect to FIG. 4. In step S20, the key is inserted into the mode change-over switch and the manager sets the mode thereof to mode 1. In the next step S4, the operator discrimination code inputted by using keyboard 5 is stored in RAM 8. The processing routine then proceeds to step S1 in which a key input value from keyboard 5 is stored in RAM 8. The processing routine then proceeds to step S2. In this step, since mode 1 is set by mode change-over switch 12, the processing routine proceeds to step S14 and thereafter step S15. In step S15, the reference value of the drawer opening time is inputted by the manager from keyboard 5 according to the operational sequence of FIG. 5*a*, and is stored in RAM 8, thereby completing the operation sequence. Next, in step S20, mode change-over switch 12 is set to mode 3 by the operator. Next, in step S4, the discrimination code of the operator inputted from keyboard 5 is stored in RAM 8. Thereafter, the processing routine proceeds to step S1. In step S1, data inputted from keyboard 5 are stored in RAM 8. The processing routine next proceeds to step S2. In step S2, since the setting mode of mode change-over switch 12 is mode 3, step S3 is started as the next processing step. In step S3, it is determined whether or not the key input value inputted from keyboard 5 in step S1 and stored in RAM 8 is a value for selecting the registering processing. When it is judged that the key input value is the value for selecting the registering processing in step S3, the processing routine proceeds to step S13 and the price of the article is then registered. When it is judged that the key input value is not the value for selecting the registering processing in step S3, the processing routine proceeds to step S5. In step S5, when the pushing-down operation (FIG. 5*c*) of a payment key is detected from keyboard 5, the processing routine proceeds to step S6, thereby opening drawer 9. When drawer 9 is open, the processing routine proceeds to step S7 in which the drawer opening time is counted up by timer 3. Next, the processing routine proceeds to step S8 in which it is judged whether or not the reference value of the drawer opening time stored in RAM 8 is a code (ØØØ) which does not allow an alarm output. When it is judged that the alarm is allowed in step S8, the processing routine proceeds to step S9. In step S9, the drawer opening time counted by timer 3 is compared with the reference value of the drawer opening time stored in RAM 8. When it is judged that the drawer opening time is not less than the reference value thereof in step S9, the processing routine proceeds to step S10. When it is judged that the drawer opening time is less than the reference value thereof in step S9, the processing routine proceeds to step S11. In step S10, an alarm sound is produced by buzzer 6 to give an alarm indicating that the drawer has been open for a time longer than the reference value of the drawer opening time. The alarm in step S10 can be given by displaying a special message and pattern on display device 2, or by outputting an alarm sound by a device for synthesizing a sound, etc., in addition to the alarm sound by the buzzer. When the processing in step S10 has been completed, the processing routine proceeds to step S11. In step S11, the opening and closing states of the drawer are detected by drawer opening-closing sensor 13 and the processing routine proceeds to step S12 when the drawer is closed. In step S12, the drawer opening time of timer 3 counted in step S7 is recorded in a recording file of the above-mentioned drawer opening time of RAM 8 together with the operator discrimination code stored in RAM 8 in step S4.

The recording file of the drawer opening time thus recorded in RAM 8 in step S12 is read out in mode 4 or 5 so that the manager can determine the time when each operator opens the drawer. Namely, in step S20, mode change-over switch 12 is set to mode 4 or 5 by the manager. Next, in step S4, the operator discrimination code is inputted from keyboard 5 and is stored in RAM 8. Next, in step S1, the key input from keyboard 5 is stored in RAM 8 and the processing routine proceeds to step S2. In step S2, since the mode set by mode change-over switch 12 is mode 4 or 5, the processing routine proceeds to step S14. In step S14, the mode set by mode change-over switch 12 is also mode 4 or 5, and therefore, the processing routine proceeds to step S16. In step S16, the mode set by mode change-over switch 12 is mode 4 or 5 and the processing routine proceeds to step S17. In step S17, the recording file of the drawer opening time made in step S12 is read out of RAM 8. Next, the processing routine proceeds tr step S18. In step S18, when the mode set by mode change-over switch 12 is mode 4, the processing operations are completed. When the mode set by mode change-over switch 12 is mode 5, the recording file of the drawer opening time made in step S12 and recorded in RAM 8 is cleared.

It should be noted that the above description and the accompanying drawings are merely illustrative of the application of the principles of the present invention and are not limiting. Numerous other arrangements which embody the principles of the invention and which fall within its spirit and scope may be readily devised by those skilled in the art.

I claim:

1. A transaction processing apparatus, comprising:
a housing;
an article holding means, supported by said housing, for opening and closing relative to said housing;
first determination means for determining when said holding means is open;
second determination means for determining when said holding means is closed;
counting means, responsive to said first determination means and said second determination means, for counting elapsed time from a first time when said first determination means determines that said holding means is open and a second time when said second determination means determines that said holding means is closed;
memory means for exploring a predetermined reference value relating to an open time of said holding means;
comparing means for comparing an elapsed time count provided by said counter means with said predetermined reference value stored in said memory means; and
alarm output means for generating an alarm output when said comparison means determines that said elapsed time count is greater than or equal to said predetermined reference value.

2. The apparatus as in claim 1, wherein said memory means includes a time setting means for selecting and setting said predetermined reference value from among a plurality of different referenced values.

3. The apparatus as in claim 1 wherein said holding means is a drawer.

4. A transaction processing apparatus, comprising:
a housing;
a holding means, supported by said housing, for opening and closing with respect to said housing;
discrimination code input means for inputting a discrimination code of an operator of said apparatus to indicate that said operator is currently responsible for operation of said apparatus;
memory means for storing said discrimination code input by said discrimination code input means;
first determination means for determining when said holding means is open;
second determination means for determining when said holding means is closed;
counter means for counting elapsed time from a first time when said first determination means determines that said holding means is open and a second time when said second determination means determines that said holding means is closed; and
recording means for recording said operator discrimination codes stored in said memory means and an elapsed time count provided by said counting means, whereby said elapsed time count and said operatory discrimination code are recorded in association with one another.

5. The apparatus as in claim 4 wherein said holding means is a drawer.

6. A transaction processing appraratus, comprising:
a housing;
a holding means, supported by said housing, for opening and closing relative to said housing;
discrimination code input means for inputting at least a first discrimination code of a first operator of said apparatus and a second discrmination code of a second operator of said apparatus;
memory means, responsive to said discrimination code input means, for storing said first discrimination code and said second discrimination code as they are input by said discrimination coda input means to provide an indication of which one of said first operator and said second operator is currently responsible for operation of said apparatus;
first determination means for determining when said holding means is open;
second determination means for determining when said holding means is closed;
counting means for counting elapsed time from a first time when said first determination means determines that said holding means is opened and a second time when said second determination means determines that said holding means is closed; and
recording means, responsive to said memory means and said counting means, for recording said first discrimination code, said second discrimination code, a first elapsed time count provided by said counter means relating to an elapsed time when said holding means is open when said first operator is currently responsible for operation of said apparatus and a second elapsed count provided by said counter means relating to an elapsed time when said holding means is open when said second operator is currently responsible for operation of said apparatus, whereby said first elapsed time count and said first discrimination code are recorded in a manner to indicate they are associated with one another and said second elapsed time count and said second discrimination code are recorded in a manner to indicate they are associated with one another.

7. The apparatus as in claim 6 wherein said holding means is a drawer.

* * * * *